US008172561B2

(12) United States Patent
Saito et al.

(10) Patent No.: US 8,172,561 B2
(45) Date of Patent: May 8, 2012

(54) METAL PART AND METHOD OF MANUFACTURING METAL PART

(75) Inventors: Toshiyuki Saito, Toyoake (JP); Takumi Mio, Kariya (JP); Koji Nishi, Anjo (JP); Hajime Fukami, Obu (JP); Atsushi Eto, Okazaki (JP); Hiroyuki Yao, Okazaki (JP)

(73) Assignee: JTEKT Corporation, Osaka-shi (JP)

( * ) Notice: Subject to any disclaimer, the term of this patent is extended or adjusted under 35 U.S.C. 154(b) by 407 days.

(21) Appl. No.: 12/479,272

(22) Filed: Jun. 5, 2009

(65) Prior Publication Data

US 2009/0301887 A1 Dec. 10, 2009

(30) Foreign Application Priority Data

Jun. 6, 2008 (JP) ..... 2008-149454
Jun. 10, 2008 (JP) ..... 2008-151884

(51) Int. Cl.
*F01C 21/10* (2006.01)
*F03C 2/00* (2006.01)
*F03C 4/00* (2006.01)
*F04C 2/00* (2006.01)

(52) U.S. Cl. ..... 418/178; 418/133; 418/179; 418/259; 205/106

(58) Field of Classification Search ..... 418/178, 418/179, 133, 259; 205/106
See application file for complete search history.

(56) References Cited

U.S. PATENT DOCUMENTS

| | | | | |
|---|---|---|---|---|
| 3,020,219 | A | 2/1962 | Franklin et al. | |
| 3,804,731 | A * | 4/1974 | Yanagida et al. | 205/325 |
| 4,801,360 | A * | 1/1989 | Tanner | 205/213 |
| 4,859,288 | A * | 8/1989 | Furneaux et al. | 205/324 |
| 5,188,522 | A * | 2/1993 | Hara | 418/268 |
| 5,595,638 | A | 1/1997 | Konuma et al. | |
| 2004/0129574 | A1 | 7/2004 | Kia et al. | |
| 2005/0031856 | A1 | 2/2005 | Kuo et al. | |

FOREIGN PATENT DOCUMENTS

| | | | |
|---|---|---|---|
| DE | 42 13 535 C1 | | 9/1993 |
| JP | 59122794 A | * | 7/1984 |
| JP | 2007-132237 | | 5/2007 |
| JP | 2007138226 A | * | 6/2007 |

* cited by examiner

*Primary Examiner* — Theresa Trieu
(74) *Attorney, Agent, or Firm* — Oblon, Spivak, McClelland, Maier & Neustadt, L.L.P.

(57) ABSTRACT

A metal part in which a base material of silicon-aluminum alloy having 1 to 25% by mass of silicon as an anode is immersed in an electrolyte together with a cathode, and at least a portion of a surface of the base material is anodized and coated with an anodic oxide film. A current density provided to both the anode and the cathode is increased from an initial current density of 0 A/dm$^2$ at a rate between 0.15 and 0.35 A/dm$^2$ per minute, wherein once the current density reaches a prescribed current density of between 0.8 A/dm$^2$ and 1.2 A/dm$^2$, the current density provided to the anode and the cathode is maintained at the prescribed current density.

8 Claims, 2 Drawing Sheets

METAL PART AND METHOD OF MANUFACTURING METAL PART

INCORPORATION BY REFERENCE

The disclosure of Japanese Patent Application No. 2008-149454 filed on Jun. 6, 2008 and Japanese Patent Application No. 2008-151884 filed on Jun. 10, 2008 including the specification, drawings and abstract is incorporated herein by reference in its entirety.

BACKGROUND OF THE INVENTION

1. Field of the Invention

The present invention relates to a metal part in which at least a portion of the surface of an aluminum alloy base material is coated with an anodic oxide film, and also relates to a method of manufacturing the metal part.

2. Description of the Related Art

In an automobile, for example, an oil pump is used to circulate oil in an engine and a hydraulic power train. The oil pump includes: a working chamber; a housing that has an intake passage and a discharge passage, both of which communicate with the working chamber, and that is configured by a plurality of housing pieces; and a rotor, disposed in the working chamber, that rotates about a shaft to draw oil from the intake passage, and discharge oil into the discharge passage.

Of the plurality of housing pieces constituting the housing, a rear housing that faces the working chamber and faces a shaft end of the rotor is formed from aluminum alloy to minimize the weight of the oil pump. In addition, in order to improve wear resistance of at least the surface of the rear housing facing the end of the rotor shaft, the surface may be coated with an anodic oxide film (see Japanese Patent Application Publication No. 2007-132237 (JP-A-2007-132237)).

SUMMARY OF THE INVENTION

An object of the present invention provides a metal part made of an aluminum alloy, such as high-silicon aluminum alloy, that exhibits improved surface smoothness, and a method of manufacturing the metal part.

In order to improve the strength of a rear housing and thereby prevent deformation thereof in response to an increase in pressure within an oil pump (e.g., 8 MPa to 15 MPa), the rear housing may be formed of a high-silicon aluminum alloy that contains approximately 1 to 25% by mass of silicon (Si). In this case, however, the surface smoothness of an anodic oxide film that is formed on the surface of the rear housing deteriorates, thereby causing wear on one end of a rotor shaft that the anodic oxide film faces.

More specifically, due to high a concentration of silicon in the high-silicon aluminum alloy, solid-phase separation of silicon is accelerated during a cool down period, thereby producing a crystalline structure in which a silicon phase is deposited over a continuous phase formed by either an aluminum phase or a eutectic phase of aluminum and silicon. Consequently, the surface of the base material presents a state that the silicon phase is exposed in a dotted manner in the continuous phase.

Due to a difference in conductivity between the continuous phase including aluminum and the silicon phase, silicon forming the silicon phase is hardly oxidized or significantly slowly oxidized, if it can be oxidized, under a condition suitable for anodization of aluminum in the continuous phase. For the above reason, the anodic oxide film grows in a selective manner particularly at its early formation stage in a region where the continuous phase on the surface of the base material is exposed (the region may be hereinafter referred to as a "continuous phase region").

After a certain level of growth, the anodic oxide film is slightly formed in a region where the silicon phase is exposed (the region may be hereinafter referred to as a "silicon phase region"). Then, the anodic oxide film that has grown in the continuous phase region enters the silicon phase region for further growth. Therefore, the anodic oxide film eventually becomes a continuous film without a significant failure in coating the silicon phase region. It should be noted that the continuous anodic oxide film described herein includes an active layer that contacts the surface of the base material and a porous layer on top of the active layer. The porous layer has a porous structure with a minute through hole in an angstrom order.

However, based on a difference in growth rates at the early growth stage, thickness of the anodic oxide film varies significantly between the both regions. Consequently, smoothness of the surface deteriorations. For the above reason, a difference in thickness of the anodic oxide film formed in the both regions particularly at the early stage is made as small as possible by using a property of the anodic oxide film that enters the silicon phase region from the continuous phase region on the surface of the base material. More specifically, a current density provided to an anode and a cathode at the early stage within a few minutes from the beginning of anodization increases from an initial current density of 0 A/dm$^2$ at a rate that is lower than or equal to 0.35 A/dm$^2$ per minute until the current density reaches a prescribed current density.

In other words, the gradual increase of the current density at the above rate can prevent rapid growth of the anodic oxide film in the continuous phase and reduce the difference in thickness of the anodic oxide film between the both regions by letting the anodic oxide film enter the silicon phase region at the early stage. After a surface of the silicon phase is completely coated with the anodic oxide film, anodization is continued at the constant current density by constant current control. Thus, it is possible to coat the whole surface of the base material with the anodic oxide film in nearly equal thickness with excellent surface smoothness.

Accordingly, a method of manufacturing a metal part according to an aspect of the present invention is a method of manufacturing a metal part in which a base material as an anode made of an aluminum alloy is immersed in an electrolyte together with a cathode, and at least a portion of a surface of the base material is anodized and coated with an anodic oxide film, the method includes: increasing a current density provided to both the anode and the cathode from an initial current density of 0 A/dm$^2$ at a rate that is lower than or equal to 0.35 A/dm$^2$ per minute, wherein once the current density reaches a prescribed current density, the current density provided to the anode and the cathode is maintained at the prescribed current density.

According to the above manufacturing method, as a rate of increase in the current density is reduced, uniform thickness of the anodic oxide film can be achieved, and the surface of the anodic oxide film can be smoothed. However, productivity of the metal part having the anodic oxide film tends to decline when the rate of increase in the current density is reduced. It is because a prolonged process is required to form the anodic oxide film in prescribed thickness.

Given that the above metal part having the anodic oxide film with excellent surface smoothness and the like is manufactured while the productivity of the metal part is maintained, the rate of increase in the current density may be at least 0.15 A/dm$^2$ per minute within the above range. In addition, the current density may be maintained at a prescribed value between 0.8 A/dm$^2$ and 1.2 A/dm$^2$ inclusive. When the current density falls below the above ranges, the prolonged process is required to form the anodic oxide film in the prescribed thickness. Consequently, the productivity of the metal part having the anodic oxide film may decline. Meanwhile, when the current density exceeds the above ranges, the anodic oxide film increases roughness on its surface, and thus wear resistance of the anodic oxide film might be lowered.

A metal part manufactured by the manufacturing method of the present invention includes a rear housing of an oil pump, for example. A surface of the rear housing that faces a working chamber and faces a shaft end of a rotor is coated with the anodic oxide film.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
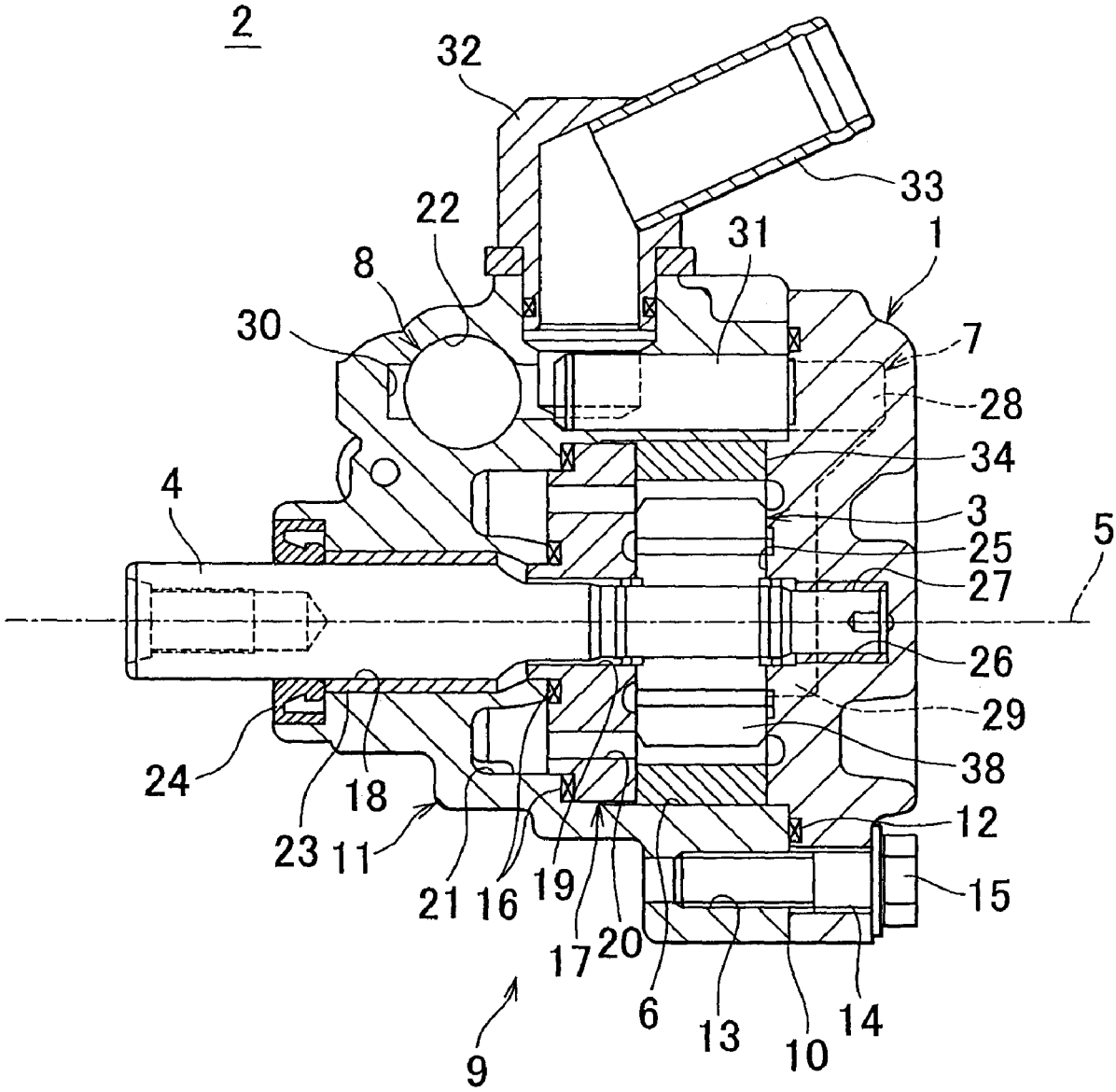
FIG. 1 is a cross-sectional view of an oil pump along an axis of a shaft of a rotor in the oil pump that includes a rear housing as an example of a metal part manufactured by a manufacturing method according to the present invention.
Figure 2:
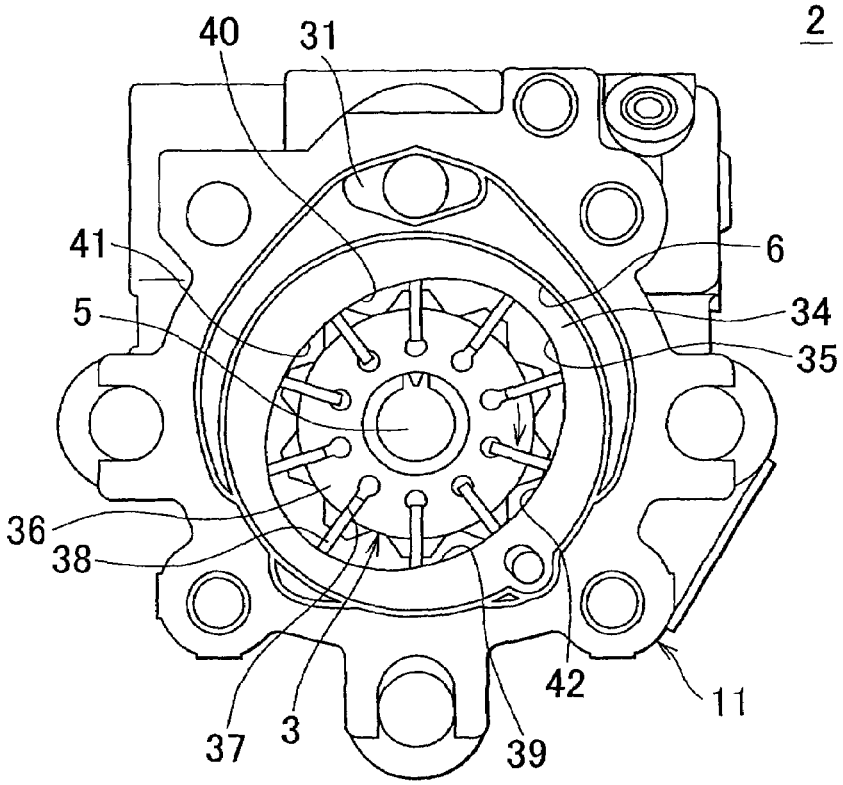
FIG. 2 is a side view that shows a state where the rear housing is removed from the oil pump in FIG. 1.

FIG. 1 is a cross-sectional view of an oil pump 2 along the axis 5 of a shaft 4 of a rotor 3 in the oil pump 2, which includes a rear housing 1 as an example of a metal part that is manufactured by the manufacturing method according to the present invention. FIG. 2 is a side view of the rear housing 1 when it is removed from the oil pump 2. Referring to FIG. 1, the oil pump 2 of this embodiment includes: a working chamber 6; a housing 9 that has an oil intake passage 7 and an oil discharge passage 8, both of which communicate with the working chamber 6; and the rotor 3 that is disposed in the working chamber 6 and that rotates about the axis 5 to draw oil from the intake passage 7 and discharge oil to the discharge passage 8 by rotation of the shaft 4.

The housing 9 is configured by a plurality of housing pieces. More specifically, the housing 9 has a front housing (housing piece) 11 and the rear housing (housing piece) 1 that can be separated by a splitting surface 10. The front housing 11 is made of an aluminum alloy, for example, and includes the working chamber 6 that is recessed from the splitting surface 10. The front housing 11 and the rear housing 1 are sealed by a seal 12 that is provided on the splitting surface 10. The front housing 11 is bolted to the rear housing 1 by a bolt 15 that is inserted through a through hole 14 provided in the rear housing 1 and screwed in a screw hole 13 provided in the front housing 11.

A first side plate (housing piece) 17 is fitted into the working chamber 6 through a seal 16. The rear housing 1 may also be referred to as a second side plate because it holds the rotor 3 together with the first side plate 17. A working chamber 6 of the front housing 11 is formed as a recess in the splitting surface 10. A through hole 18 is formed roughly in the center, that is located at a bottom surface of the working chamber 6 of the front housing 11, of working chamber 6 of the front housing 11. A shaft 4 is inserted through the through hole 18 in a direction of the axis 5 that is perpendicular to the splitting surface 10.

The first side plate 17 is formed with a through hole 19 that passes through a space between a surface that faces the rotor 3 housed in the working chamber 6 and a surface that faces the bottom surface of the working chamber 6 and communicates with the through hole 18, and through which the shaft 4 is inserted in a state where the first side plate 17 is fitted into the working chamber 6. A discharge port 20 that passes through the space between the above surfaces is formed in two positions around the through hole 19. The discharge ports 20 are formed in positions in the first side plate 17 that are symmetrical about the axis 5 and parallel to the through hole 19.

An annular discharging recess 21 is connected to the discharge port 20 around the through hole 18 that is formed in the bottom surface of the working chamber 6. The discharge passage 8 is configured by the discharge port 20, the discharging recess 21, and a passage 22 that is formed in the front housing 11. A cylindrical metal bearing 23 is disposed in the through hole 18 to support the shaft 4 for rotation. An opening of the through hole 18 opposite from that in the working chamber 6 is provided with a seal 24 that seals the shaft 4 and the front housing 11.

An inner surface 25 of the rear housing 1 that faces the rotor 3 is provided with a recessed portion 26 in which an end of the shaft 4 is inserted. A cylindrical metal bearing 27 is disposed in the recessed portion 26 to support the shaft 4 for rotation. A passage 28 (shown in a dotted line in the drawing) that constitutes the intake passage 7 is provided in the rear housing 1. In the inner surface 25, a suction port 29 (also shown in the dotted line in the drawing) is provided in two positions around the recessed portion 26. The suction ports 29 are formed in the inner surface 25 so as to be symmetrical about the axis 5, and connect the passage 28 with the working chamber 6.

The front housing 11 is provided with passage members 31 and 32 that constitute the intake passage 7 together with the passage 28 and the suction port 29 and also constitute a flow rate control valve that returns a portion of excessive oil flowing through the discharge passage 8 to the intake passage 7 via a bypass passage 30. A suction cylinder 33 as an oil inlet is connected to the passage member 32. Referring to FIG. 1 and FIG. 2, a cylindrical cam ring 34 that is held between the first side plate 17 and the rear housing 1 is fitted into the working chamber 6 so as to surround the rotor 3. A cylindrical inner peripheral surface of the cam ring 34 is a cam surface 35 that has an oval shape in a direction perpendicular to the axis 5.

The rotor 3 has a rotor main body 36 that is integrally attached to the shaft 4. A plurality of grooves 37 is provided radially from the outer peripheral surface of the rotor main body 36 toward the axis 5. A plurality of vanes 38 is fitted into the plurality of grooves 37 and disposed radially outward from the outer peripheral surface. Each of the vanes 38 is provided to be removable from the groove 37 and urged radially outward by hydraulic pressure on the vanes. When the shaft 4 is rotated, the vane 38 is urged radially outward by hydraulic pressure and rotates together with the rotor main body 36 while maintaining a state that an end of the vane 38 contacts the cam surface 35 of the cam ring 34. The suction port 29 is provided in two positions in the inner surface 25 of the rear housing 1 that correspond to chambers 39 and 40 partitioned by the adjacent vane 38 in a state shown in FIG. 2. The suction port 20 is provided in two positions in the first side plate 17 that correspond to chambers 41 and 42 partitioned by the adjacent vane 38 in a state shown in FIG. 2.

When the shaft 4 is rotated in a direction shown by a solid arrow in FIG. 2, it is possible for the chamber 39, which is partitioned by the vane 38, to suction oil from the intake passage 7 and discharge oil to the discharge passage 8 by rotating in a direction from the suction port 29 to the discharge port 20. At this time, suction power and discharge power are generated in the chamber 39 in conjunction with the rotation, and thus backflow of oil is prevented.

More specifically, since volumes of the chambers 39 and 40 that move away from the suction port 29 are increased on the basis of the shape of the cam surface 35, the power to suction oil from the intake passage 7 and the suction port 29 into the chambers 39 and 40 is generated. Regarding the discharge power, since volumes of the chambers 41 and 42 that approach the discharge port 20 are reduced on the basis of the shape of the cam surface 35, the power to discharge oil from the chambers 41 and 42 to the discharge port 20 and the discharge passage 8 is generated.

The first side plate 17, the cam ring 34, the rotor main body 36, and the vane 38 are, for example, made of alloy that contains iron (Fe), nickel (Ni), molybdenum (Mo), and carbon (C), and preferably sintered alloy that contains iron (Fe), nickel (Ni), copper (Cu), molybdenum (Mo), and carbon (C). In order to their increase strength and wear resistance, the above components are preferably high-density sintered bodies with a density of $\rho$=7.25 g/cm$^3$ or higher and particularly with a density from 7.25 to 7.5 g/cm$^3$ that are formed by high-density warm die wall lubrication. Furthermore, the above components are formed from the high-density sintered bodies to which a carburizing quenching process is applied. In other words, the above components are formed from sintered bodies to which a vacuum carburizing process and the like and a subsequent quenching process are applied.

For purposes of weight reduction of the oil pump 2 and improved strength of the rear housing 1 and the front housing 11 in response to an increase in pressure within the oil pump (e.g., 8 MPa to 15 MPa) to prevent deformation of the rear housing 1 and the front housing 11, the rear housing 1 and the front housing 11 are formed from aluminum alloy and particularly formed from high-silicon aluminum alloy that contains, for example, 1 to 25% by mass of silicon and particularly 10 to 20% by mass of silicon. The inner surface 25 of the rear housing 1, which faces the shaft end of the rotor 3, that is, which faces a side surface of the rotor main body 36 and a side edge of the vane 38, and on which the side surface and the side edge slide, is coated with an anodic oxide film (not shown) so as to increase wear resistance.

However, if the rear housing 1 as a base material, which is of the abovementioned high-silicon aluminum alloy, is anodized under a normal condition, as described above, the surface smoothness of the anodic oxide film is decreased to produce wear on the rotor main body 36 and the vane 38. On the other hand, in a state where the rear housing 1 as the base material is an anode and immersed in electrolyte together with a cathode, the inner surface 25 is coated with the anodic oxide film through (1) a first process in which a current density the current provided to both the anode and the cathode starts at 0 A/dm$^2$ and is increased at a rate of 0.35 A/dm$^2$ per minute or lower and (2) a second process in which, once the current density reaches a prescribed current density in the first process, anodization is continued while the prescribed current density is maintained. As a result, the surface smoothness of the anodic oxide film is improved.

Therefore, the inner surface 25 that is coated with the anodic oxide film does not cause wear on the rotor main body 36 and the vane 38, and the rear housing 1 with improved wear resistance may be manufactured. As the rate of increase in the current density is reduced in the first process, an anodic oxide film, which is formed through the first and second processes, of uniform thickness is formed, and thus the surface of the anodic oxide film may be smoothed. However, productivity of the metal part having the anodic oxide film tends to decline if the rate of increase in the current density is reduced in the first process. It is because a prolonged process is required to form the anodic oxide film in prescribed thickness.

Therefore, in consideration of favored productivity of the rear housing 1 having the anodic oxide film with excellent surface smoothness, it is preferable that the current density in the first process be increased at a rate of at least 0.15 A/dm$^2$ per minute and particularly from 0.16 to 0.34 A/dm$^2$ per minute within the above range. The current density may start at 0 A/dm$^2$ and be increased to the prescribed current density in a linear or stepwise manner.

It is preferable in the second process that the prescribed current density be maintained between 0.8 A/dm$^2$ and 1.2 A/dm$^2$ inclusive and particularly between 0.9 A/dm$^2$ and 1.1 A/dm$^2$ inclusive by constant current control. When the current density falls below the above ranges, the prolonged processes are required to form the anodic oxide film in the prescribed thickness. Consequently, productivity of the metal part having the anodic oxide film may decline. Meanwhile, when the current density exceeds the above ranges, the anodic oxide film increases roughness on its surface to cause a possible decrease in abrasion resistance thereof and performance of the oil pump.

In the anodization, the rear housing 1 as a base material is preferably pretreated with degrease and the like, for example, before being immersed in the electrolyte. It is acceptable as long as the anodic oxide film coats at least the inner surface 25 of the rear housing 1. In addition, the other surfaces of the rear housing 1 may be masked if only the inner surface 25 is selectively coated with the anodic oxide film. However, in order to eliminate the masking work and improve the wear resistance of all the surfaces of the rear housing 1, it is preferable that all the surfaces of the rear housing 1 including the inner surface 25 be coated with the anodic oxide film.

Lead (Pb), carbon (C), or the like is used as a cathode. The electrolyte may include sulfate bath, oxalic bath, chromic acid bath, phosphoric acid bath, alkaline bath and the like, and sulfate bath is particularly preferred. The electrolyte is preferably at a temperature from 10 to 40° C. and particularly from 10 to 20° C. in consideration of forming a dense anodic oxide film with hardness as high as possible, and also in consideration of maintaining productivity of the rear housing 1 by preventing the selective and rapid growth of the anodic oxide film in the continuous phase region particularly at the early formation stage while a certain level of growth is secured.

The anodic oxide film formed by anodization includes an active layer that contacts the inner surface 25 of the rear housing 1 and the like and a porous layer on top of the active layer. The porous layer has a porous structure with a minute through hole in an angstrom order. Therefore, favorable lubricity of the rotor main body 36 and the vane 38 can be achieved by holding oil in the through hole of the porous layer. In addition, if the oil pump 2 is used particularly in a high-temperature environment near an engine in an automobile, for example, the through hole of the porous layer may be impregnated with a solid lubricant such as molybdenum disulfide ($MoS_2$) so as to prevent seizure of the rear housing 1 with the rotor main body 36 and the vane 38.

The formed anodic oxide film is preferably boiled in water and undergoes a sealing process so as to improve its surface smoothness, corrosion resistance and the like. As described above, the surface of the anodic oxide film is desired to be as smooth as possible so as not to produce wear on the rotor main body 36 and the vanes 38. More specifically, it is preferable that ten point height of roughness profile $R_{ZJIS94}$ of the anodic oxide film that is coated on the inner surface 25 through the first and second processes be 3 μm or lower when the inner surface 25 has 1 μm of the ten point height of roughness profile $R_{ZJIS94}$, which is defined in appendix 1 of Japan Industrial Standards (JIS) B0601: 2001, "Geometrical Product Specifications (GPS)—Surface texture: Profile method—Terms, definitions and surface texture parameters". The lower limit of the ten point height of roughness profile is 0 μm, that is, the completely smooth surface is ideal. However, the ten point height of roughness profile is preferably 2 μm in reality.

The anodic oxide film is preferably 6 to 15 μm and particularly 8 to 10 μm in thickness in consideration of maintaining productivity of the rear housing 1 and providing improved wear resistance to the inner surface 25 of the rear housing 1. The anodic oxide film is measured for its internal hardness (hardness at a depth of 1 mm from the surface) in accordance with a measuring method defined in Japan Industrial Standards (JIS) Z2244: 2003, "Vickers hardness test—Test method". To provide sufficient wear resistance to the inner surface 25 of the rear housing 1, it is preferable that the surface of the anodic oxide film have a hardness of HV200 to 300 expressed by Vickers hardness HV0.01 if the inner surface 25 has a hardness of HV150 expressed by the same Vickers hardness HV0.01 with a test force of 0.09807 N.

The present invention is not limited in its application to manufacture of the rear housing 1 of the oil pump 2 as shown in the examples in the drawings as described above. In addition, the present invention is applicable to various metal parts made of an aluminum alloy, in particular a high-silicon aluminum alloy, that is coated with an anodic oxide film over at least a portion of its surface. In the above case, ten point height of roughness profile, thickness, hardness, and the like of the anodic oxide film can be set accordingly within a range favorable to a specific metal part. Furthermore, the present invention may be modified in various ways without departing from the scope of the present invention.

Next, a description will be made on a sintered body that constitutes the rotor 3. As described above, in order to improve the wear resistance, the rotor main body 36 that constitutes the rotor 3 is preferably a sintered body made of alloy that contains iron (Fe), nickel (Ni), molybdenum (Mo), and carbon (C), and particularly made of alloy that contains iron (Fe), nickel (Ni), copper (Cu), molybdenum (Mo), and carbon (C). Preferably, the first side plate 17 and the cam ring 34 are also formed from the same sintered body.

When the sintered body is the rotor main body 36, in order to obtain tenacity by nickel, the sintered body preferably has the rate of each metal component as follows: 0.5 to 5.5% by mass of nickel, and particularly 3 to 4% by mass of nickel; 0.1 to 1.0% by mass of molybdenum; 0.5 to 2.0% by mass of copper; and 0.1 to 0.8% by mass of carbon. The rest of the sintered body is preferably iron and other inevitable impurities. When the sintered body is the first side plate 17 and the cam ring 34, in order to obtain wear resistance by molybdenum, the sintered body preferably has: 0.5 to 5.5% by mass of nickel, and particularly 3 to 4% by mass of nickel; 0.5 to 1.5% by mass of molybdenum; 0 to 2.0% by mass of copper; and 0.1 to 0.8% by mass of carbon. The rest of the sintered body is preferably iron and other inevitable impurities.

In either of the above cases, the carbon content is indicated as that after the carburizing quenching process if the process is applied. The sintered body can be manufactured by high-density warm die wall lubrication with using raw powder that contains carbon powder and metal powder of an iron-nickel-molybdenum series or an iron-nickel-copper-molybdenum series, for example. The reason to contain carbon powder in advance is to compensate the carburizing quenching process on the high-density sintered body, which tends to be insufficient. By inclusion of the carbon powder and adoption of the vacuum carburizing process for the carburizing quenching process, the carburizing quenching process can be applied sufficiently on the high-density sintered body so as to improve the wear resistance of the high-density sintered body.

In the high-density warm die wall lubrication, a higher fatty acid lubricant such as lithium stearate is initially applied to walls of a die that corresponds to the shape of the rotor main body 36 and the like. Then, the raw powder is hot-filled into the die while the die and the raw material are heated at 150° C. or higher but below the melting point of the higher fatty acid lubricant (e.g., approximately 200° C.). At this time, powder of the same higher fatty acid lubricant may be contained in the raw powder in the proportion of 0.2 by mass of the higher fatty acid lubricant to 100 by mass of the raw powder.

Next, the raw powder filled in the die is pressurized at approximately 600 to 700 MPa to cast a compact body. Then, the compact body that is taken out of the die undergoes sintering at a temperature of approximately 1,100 to 1,400° C. for 40 to 80 minutes so as to obtain a sintered body. The higher fatty acid lubricant functions as a lubricant during hot filling and helps increase the filling density of the raw powder. In addition, the higher fatty acid lubricant increases its lubricity by forming iron stearate, if the higher fatty acid lubricant is lithium stearate, in a mechanochemical reaction with iron under high pressure when the compact body is die-cast. Thus, the higher fatty acid lubricant facilitates easy removal of the compact body from the die. Therefore, it is possible to manufacture the high-density sintered body, which satisfies the abovementioned density, from the compact body.

The vacuum carburizing process is favorably adopted when the sintered body undergoes the carburizing quenching process. In the vacuum carburizing process, the sintered body is heated in vacuum at a temperature of approximately 800 to 1,100° C. while introducing carburized gas, and is further heated for approximately 200 to 300 minutes so as to sufficiently carburize inside of the high-density sintered body. After the carburized sintered body is immersed in oil at a temperature of 50 to 70° C. and quenched, the carburizing quenching process is completed. Thereafter, the sintered body may undergo an annealing process to be heated at a temperature of 180 to 200° C. for 60 to 80 minutes if necessary.

The sintered body that is manufactured through the above processes is measured for its density in accordance with a measuring method defined in Japan Industrial Standards (JIS) Z2505: 1989 "Method for determination of density of sintered metal materials". As described above, the density of the sintered body is preferably between 7.25 g/cm$^3$ and 7.5 g/cm$^3$ inclusive and particularly between 7.3 g/cm$^3$ and 7.45 g/cm$^3$. If the density of the sintered body is below the above ranges, the wear resistance of the sintered body, that is, the rotor main body 36, the vane 38, the first side plate 17, and the cam ring 34 may not be improved sufficiently. On the other hand, when the density of the sintered body exceeds the above ranges, the sintered body may be insufficiently quenched and thus lower its strength.

The sintered body is measured for its internal hardness by a measuring method defined in abovementioned JIS Z2244: 2003 "Vickers hardness test—Test method". Especially when the sintered body is the rotor main body 36, in consideration of maintaining the sufficient wear resistance on its surface and providing favorable tenacity thereto, it is preferable that the hardness inside the sintered body be HV 700 to 800 in a region at a depth of 0.1 to 0.2 mm from the surface with a test force of 0.2 N and be HV 500 to 600 at a depth of approximately 1 mm. The sintered body with such a hardness distribution can be manufactured when it is formed from the above composition alloy for the rotor main body 36 and applied with the carburized quenching process.

The vane 38 can be formed from a steel material such as ball-bearing steel (SUJ2) or the steel material with a plated surface. The configuration of the oil pump 2 is not limited to the examples in the drawings, which have been described above, and various modifications can be made without departing from the scope of the present invention.

Example 1

As a base material, a flat plate member (25 mm in height× 25 mm in width×5 mm in thickness) that is made of high-silicon aluminum alloy with 14% by mass of silicon was prepared. High-silicon aluminum alloy that constitutes the plate member had a hardness of HV 150 at a depth of 1 mm from the surface with Vickers hardness scale HV 0.01. Ten point height of roughness profile $R_{ZJIS94}$ on the surface of the plate member was set to be 1 μm.

The plate member was degreased in advance, connected to an anode of a power supply device, and immersed in a sulfate bath together with a graphite cathode. A current density of current provided to both the anode and the cathode started at 0 A/dm$^2$ in the first process and was increased for 3 minutes at a rate of 0.333 A/dm$^2$ per minute to reach 1 A/dm$^2$. Next, once the current density reached a prescribed current density in the first process, the current density was further maintained for 37 minutes, that is, a total of 40 minutes for anodization. Then, the base material was taken out of the sulfate bath, rinsed with water, and further boiled in water for a sealing process. Consequently, a metal part with a surface coated with an anodic oxide film was manufactured.

Example 2

A metal part having a surface coated with an anodic oxide film was manufactured in the same manner as Example 1 except that the current density of the current provided to both the anode and the cathode started at 0 A/dm$^2$ in the first process and was increased for 6 minutes at a rate of 0.167 A/dm$^2$ per minute to reach 1 A/dm$^2$ and that the current density was further maintained for 34 minutes, that is, a total of 40 minutes for anodization.

Comparative Example 1

A metal part having a surface coated with an anodic oxide film was manufactured in the same manner as Example 1 except that the current density of the current provided to both the anode and the cathode started at 0 A/dm$^2$ in the first process and was increased for 1 minute at a rate of 1 A/dm$^2$ per minute to reach 1 A/dm$^2$ and that the current density was further maintained for 39 minutes, that is, a total of 40 minutes for anodization.

(Measurement of Surface Roughness) The surface of the anodic oxide film of each metal part that is manufactured in Examples 1 and 2 and Comparative Example 1 was measured for ten point height of roughness profile $R_{ZJIS94}$ by a profilometer. Measuring conditions were: 6 sections; cutoff values of $\lambda_C$=0.8 mm and $\lambda_S$=0.0025 mm; and a measuring speed of 0.5 mm/sec. The ten point height of roughness profile $R_{ZJIS94}$ was calculated by applying Gaussian filter to the measurement.

(Thickness Measurement) the metals parts manufactured in Examples 1 and 2 and Comparative Example 1 were cut in a thickness direction of the anodic oxide film. A cut surface was filled with resin, polished, and micrographed at 400-fold magnification. A mean value of thickness was calculated from thickness measured in ten points on the micrograph, and thickness of the anodic oxide film was obtained. In addition, a difference between the maximum value and the minimum value of the thickness measurements in the ten points was calculated to evaluate dispersion in thickness of the ten points.

(Hardness Measurement) The surface of the anodic oxide film of each metal part manufactured in Examples 1 and 2 and Comparative Example 1 was lap-polished and then measured for its hardness with Vickers hardness scale HV 0.01.

(Ball-on-Plate Friction Test) A ball of 4.76 mm in diameter that is made of a ball-bearing steel (SUJ2) was slid to make a circle of 20 mm in diameter on the surface of the anodic oxide film of each metal part (plate) manufactured in Example 1 and Comparative Example 1 with application of a load of 10 N in a thickness direction of the anodic oxide film while a point of a sphere is in constant contact with the surface of the anodic oxide film. A sliding speed was 0.08 m/s, and a sliding distance was 432 m. In addition, the above slide was conducted in a state that the metal part and the ball were immersed in PS oil (JTEKT Corporation, oil temperature at 100° C.).

The surface of the ball after the slide was observed with a microscope to measure a wear radius "a" (mm). A wear depth "h" (mm) was obtained by substituting the wear radius "a" and a radius of the ball "r" (=2.38 mm) into an equation (A).

$$\text{Wear Depth } h = r - \sqrt{(r^2 - a^2)} \tag{A}$$

Next, a wear volume (mm$^3$) was obtained by substituting the wear depth "h" and the wear radius "a" into an equation (B).

$$\text{Wear Volume} = \frac{\pi h}{6}(3a^2 + h^2) \tag{B}$$

Furthermore, a specific wear volume (mm 3/N·m) of the ball as an indicator of wear produced by the anodic oxide film on an opposed member was obtained by substituting the wear volume, the load (=10 N), and the sliding distance (=432 m) into an equation (C).

$$\text{Specific Wear Volume} = \frac{\text{Wear Volume}}{\text{Load} \times \text{Sliding Distance}} \tag{C}$$

The above equation indicates that wear produced by the anodic oxide film on the opposed member is smaller as the specific wear volume is small. Moreover, a comparison was made on roughness curves of the plate surface before and after the slide that were measured by the profilometer so as to obtain a width "b" (mm) and a depth "d" (mm) of the wear on the plate surface that was formed by slide of the ball. Then, a virtual radius R (mm) of a wear section was obtained by substituting the above values into an equation (D).

$$\text{Virtual Radius } R = \frac{d2 + (b/2)^2}{2d} \quad \text{(D)}$$

Then, a virtual fan angle Φ (°) of the wear was obtained by substituting the virtual radius R and the wear width "b" into an equation (E).

$$\text{Virtual Fan Angle } \Phi = \frac{b/2}{R} \quad \text{(E)}$$

A wear volume ($mm^3$) was obtained by substituting the virtual radius R, the angle Φ, the width "b", and the depth "d" into an equation (F).

$$\text{Wear Volume} = 2\pi r\left\{\frac{\pi \times R^2 \times \Phi}{360°} - \frac{b(R-d)}{2}\right\} \quad \text{(F)}$$

Next, a specific wear volume ($mm^3$/N·m) of the plate as an indicator of the wear resistance of the anodic oxide film was obtained by substituting the wear volume, the load (=10 N), and the sliding distance (=432 m) into the equation (C). It is indicated that the wear resistance of the anodic oxide film is higher as the specific wear volume is small. The results obtained from the above are summarized in Table 1.

TABLE 1

| | | Comparative Example 1 | Example 1 | Example 2 |
|---|---|---|---|---|
| Increasing amount of current density in the first process ($A/dm^2$ × minute) | | 1 | 0.333 | 0.167 |
| Ten point height of roughness profile $R_{ZJIS94}$(μm) | | 3.6 | 2.9 | 2.6 |
| Thickness (μm) | Mean value | 6.9 | 8.6 | 5.8 |
| | Dispersion | 13 | 4.3 | 6 |
| Vickers hardness HV0.001 | | 231 | 229 | 226 |
| Specific wear amount of a ball ($mm^3$/N · m) | | $1.4 \times 10^{-7}$ | $3.7 \times 10^{-8}$ | — |
| Specific wear amount of a plate ($mm^3$/N · m) | | $1.2 \times 10^{-5}$ | $6.7 \times 10^{-6}$ | — |

From the Table 1, it is confirmed that the metal parts of Examples 1 and 2, to which the current density was increased at the rate below 0.35 $A/dm^2$ per minute in the first process of anodization, have a small dispersion in thickness of the anodic oxide film, have excellent surface smoothness, and do not produce wear on the opposed member when compared to the metal part of Comparative Example 1, to which the current density was increased at the rate exceeding the above range. In addition, when a comparison is made between Example 1 and Example 2, thickness of the anodic oxide film in Example 2 tends to be thinner than that in Example 1. Therefore, it is confirmed that an increase of the current density at the rate over 0.15 $A/dm^2$ is preferred in the first process so as to form the anodic oxide film in sufficient thickness in the shortest possible time and thus to improve the productivity of the metal part.

(Actual Machine Test) The rear housing 1 in a shape as shown in FIG. 1 was formed from high-silicon aluminum alloy with 14% by mass of silicon, which was also used in Example 1 and Comparative Example 1. Then, the anodic oxide film was formed at least on the inner surface 25 that faces the rotor 3 by anodization under the same conditions as those in Example 1 and Comparative Example 1.

The rear housing 1 was first die-cast in a prescribed shape with using the raw powder that contains carbon powder and metal powder of an iron-nickel-molybdenum series by high-density warm die wall lubrication. Next, the rear housing 1 was assembled with the rotor main body 36 that was formed in the vacuum carburizing process, the vanes 38 made of ball-bearing steel SUJ2, and the like to constitute the oil pump 2, which is shown in FIG. 1 and FIG. 2. The density of the rotor main body 36 was 7.4 $g/cm^3$, and Vickers hardness thereof with a test force of 0.2 N was HV 730 in a region at a depth of 0.1 to 0.2 mm from the surface thereof and HV 500 at a depth of approximately 1 mm from the surface thereof.

The oil pump 2 was continuously operated for 110 hours under the conditions below.

(Operating Conditions) lubricant oil: PS pump oil, oil temperature: 100° C. or higher, pump pressure: 15 MPa or higher, and a sliding speed at the end of the vane 38: 3.9 m/s or faster. Next, the rear housing 1 was removed. A region of the inner surface 25 that contacted the rotor main body 36 and the vanes 38 was measured for its wear depth (μm) by a contact profilometer under measurement conditions below. Then, the maximum value of the wear depth was obtained. A measurement was taken in one direction from a point on a peripheral edge of the region through the recessed portion 26 in the center to a point at the peripheral edge on the opposite side of the region.

(Measurement Conditions) Stylus tip R: 2 μm, a measuring speed: 0.5 mm/s.

Figure 3:
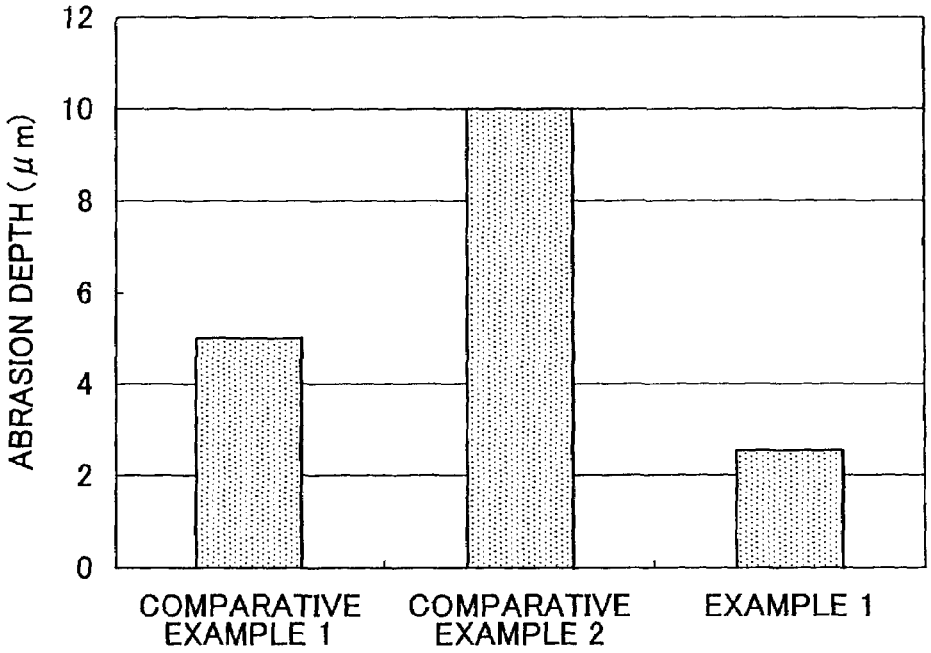
FIG. 3 is a graph that shows the maximum value of wear depth on an inner surface of the rear housing measured after an actual machine test was conducted with using the rear housing that is manufactured in an example and a comparative example of the present invention.

Results of the above measurements are summarized in Table 2 and FIG. 3 along with the result of a case where the inner surface 25 and the like of the rear housing 1 were not anodized (Comparative Example 2) for comparison.

TABLE 2

| | | Comparative Example 1 | Comparative Example 2 | Example 1 |
|---|---|---|---|---|
| Increasing amount of current density in first process ($A/dm^2$ × minute) | | 1 | — | 0.333 |
| Ten point height of roughness profile $R_{ZJIS94}$ (μm) | | 3.6 | — | 2.9 |
| Thickness (μm) | Mean value | 6.9 | — | 8.6 |
| | Dispersion | 13 | — | 4.3 |
| Vickers hardness HV0.001 | | 231 | — | 229 |
| Wear depth of inner surface 25 (μm) | | 5 | 10 | 2.5 |

It was confirmed from Table 2 that, in Example 1 in which the current density was increased at the rate below 0.35 $A/dm^2$ per minute in the first process of anodization, the thickness dispersion of the anodic oxide film is low, and the excellent surface smoothness was obtained compared to Comparative Example 1 in which the current density was increased at the rate over the above range. It was also confirmed from Table 2 and FIG. 3 that the rear housing with the configuration in Example 1 has improved wear resistance of its own when compared to Comparative Example 1 and Comparative Example 2 in which the anodic oxide film was not formed.

What is claimed is:

1. A metal part comprising:

a base material made of a silicon-aluminum alloy having 1 to 25% by mass of silicon, and an anodic oxide film coated over at least a portion of a surface of the base material, wherein the anodic oxide film is formed by anodizing the base material at a current density that is provided to both the anode and a cathode and that increases from an initial current density of 0 $A/dm^2$ at a rate that is higher than or equal to 0.15 $A/dm^2$ per minute and lower than or equal to 0.35 $A/dm^2$ per minute, and once the current density reaches a prescribed current density of between 0.8 $A/dm^2$ and 1.2 $A/dm^2$, the current density provided to the anode and the cathode is maintained at the prescribed current density.

2. The metal part according to claim 1, wherein:

the base material is a rear housing of an oil pump;

the oil pump includes:

a working chamber;

a housing that has an intake passage and a discharge passage, both of which communicate with the working chamber, wherein the housing is comprised by a plurality of housing pieces; and a rotor that is disposed in the working chamber and that rotates about a shaft to draw oil from the intake passage and discharge the oil into the discharge passage;

the rear housing is one of the housing pieces that faces the working chamber and a shaft end of the rotor; and at least a surface of the rear housing that faces the shaft end of the rotor is coated with the anodic oxide film.

3. The metal part according to claim 2, wherein the rotor is a sintered body of an alloy that contains iron, nickel, molybdenum, and carbon, and a density of the alloy is higher than or equal to 7.25 $g/cm^3$.

4. The metal part according to claim 3, wherein the density of the alloy is lower than or equal to 7.5 $g/cm^3$.

5. The metal part according to claim 3, wherein the rotor is made of the sintered body that has been vacuum carburized, wherein the sintered body is vacuum carburized by heating the sintered body in a vacuum while a carburized gas is introduced and then quenching the sintered body by immersion in oil.

6. The metal part according to claim 1, wherein the anodic oxide film has a thickness dispersion of 6 μm or less.

7. The metal part according to claim 1, wherein the anodic oxide film has a ten point surface roughness of 3 μm or less when the base material has a surface roughness of 1 μm or less according to Japan Industrial Standards (JIS) B0601: 2001.

8. The metal part according to claim 1, wherein the silicon-aluminum alloy contains 14% by mass of silicon.

* * * * *